US011841650B2

(12) United States Patent
Saito et al.

(10) Patent No.: US 11,841,650 B2
(45) Date of Patent: Dec. 12, 2023

(54) TRANSFER BELT AND IMAGE FORMING APPARATUS

(71) Applicant: CANON KABUSHIKI KAISHA, Tokyo (JP)

(72) Inventors: Shuji Saito, Shizuoka (JP); Noriaki Egawa, Tokyo (JP); Masatsugu Toyonori, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/552,249

(22) Filed: Dec. 15, 2021

(65) Prior Publication Data

US 2022/0197191 A1 Jun. 23, 2022

(30) Foreign Application Priority Data

Dec. 23, 2020 (JP) ..... 2020-213832

(51) Int. Cl.
*G03G 15/16* (2006.01)

(52) U.S. Cl.
CPC ..... *G03G 15/162* (2013.01); *G03G 15/161* (2013.01)

(58) Field of Classification Search
CPC ..... G03G 15/161; G03G 15/162
See application file for complete search history.

(56) References Cited

U.S. PATENT DOCUMENTS

2007/0201911 A1* 8/2007 Ito ..... G03G 15/161 399/299
2015/0177653 A1* 6/2015 Seki ..... G03G 15/162 399/101
2015/0212458 A1* 7/2015 Nakajima ..... G03G 15/1675 399/313
2018/0217522 A1* 8/2018 Yoshida ..... G03G 9/09

FOREIGN PATENT DOCUMENTS

JP 2013068733 A 4/2013
JP 5566522 B1 8/2014
JP 2018025832 A 2/2018
JP 2019191511 A 10/2019
JP 2020149018 A 9/2020

* cited by examiner

*Primary Examiner* — Stephanie E Bloss
*Assistant Examiner* — Michael A Harrison
(74) *Attorney, Agent, or Firm* — Canon U.S.A., Inc. I.P. Division

(57) ABSTRACT

A transfer belt, to be used in a state of being in contact with a cleaning member and an image carrier, and to which a developer image is to be transferred from the image carrier, includes a surface layer and a base layer. The surface layer is in contact with the image carrier and the cleaning member. The base layer disposed at a position more apart from the image carrier and the cleaning member than the surface layer. The surface layer is provided with grooves formed by transferring a predetermined mold shape and extending in a first direction along a moving direction of the transfer belt in an operating state. The arithmetic average roughness of the surface layer in a predetermined region is less than or equal to 0.2 μm.

12 Claims, 7 Drawing Sheets

TRANSFER BELT AND IMAGE FORMING APPARATUS

BACKGROUND

Field

The present disclosure relates to an image forming apparatus employing an electrophotographic method, and a transfer belt used in the image forming apparatus.

Description of the Related Art

Some image forming apparatuses employ an "intermediate transfer method" using a transfer belt (endless belt) as an intermediate transfer member. In such image forming apparatuses, photosensitive drums and a cleaning blade are disposed in contact with the surface of the transfer belt.

Japanese Patent Application Laid-Open No. 2019-191511 discusses a configuration having a plurality of grooves on the surface (outer circumferential surface) of a transfer belt in contact with a cleaning blade, to reduce the friction at the contact portion between the transfer belt and the cleaning blade. The grooves extend along the moving direction of the transfer belt.

In the configuration discussed in Japanese Patent Application Laid-Open No. 2019-191511, the grooves on the surface of the transfer belt are formed by using an "imprint processing method". The "imprint processing method" refers to a processing method for transferring a predetermined "mold shape" to an object and forming a shape conforming to the mold shape on the object. For example, this method presses a mold having "convex" shapes onto the object to form "concave" shapes conforming to the convex shapes on the object.

Japanese Patent No. 5566522 discusses a configuration for forming predetermined wavy shapes on the surface (outer circumferential surface) of a transfer belt in contact with each photosensitive drum, to reduce the friction at the contact portion between the photosensitive drum and the transfer belt.

However, the wavy shapes on the surface of the transfer belt may affect the condition of the grooves formed by the imprint method. More specifically, when further forming grooves on the surface of the transfer belt with wavy shapes formed thereon as discussed in Japanese Patent No. 5566522 by using the imprint processing method discussed in Japanese Patent Application Laid-Open No. 2019-191511, desired grooves (structures) may not be obtained on the surface of the transfer belt. In this case, friction between the cleaning blade and the transfer belt is not sufficiently decreased, and thus a "stick-slip phenomenon" (also referred to as a blade chatter phenomenon) may occur.

SUMMARY

The present disclosure is directed to providing a transfer belt and an image forming apparatus for reliably reducing the friction between a cleaning member and an image carrier.

According to an aspect of the present disclosure, a transfer belt, to be used in a state of being in contact with a cleaning member and an image carrier, and to which a developer image is to be transferred from the image carrier, includes a surface layer in contact with the image carrier and the cleaning member, and a base layer disposed at a position more apart from the image carrier and the cleaning member than the surface layer, wherein the surface layer is provided with grooves formed by transferring a predetermined mold shape and extending in a first direction along a moving direction of the transfer belt in an operating state, and wherein an arithmetic average roughness of the surface layer in a predetermined region is less than or equal to 0.2 μm.

Further features of the present disclosure will become apparent from the following description of exemplary embodiments with reference to the attached drawings.

DESCRIPTION OF THE EMBODIMENTS (Configuration of Image Forming Apparatus)

An image forming apparatus according to the present exemplary embodiment will now be described with reference to FIG. 1.

Figure 1:
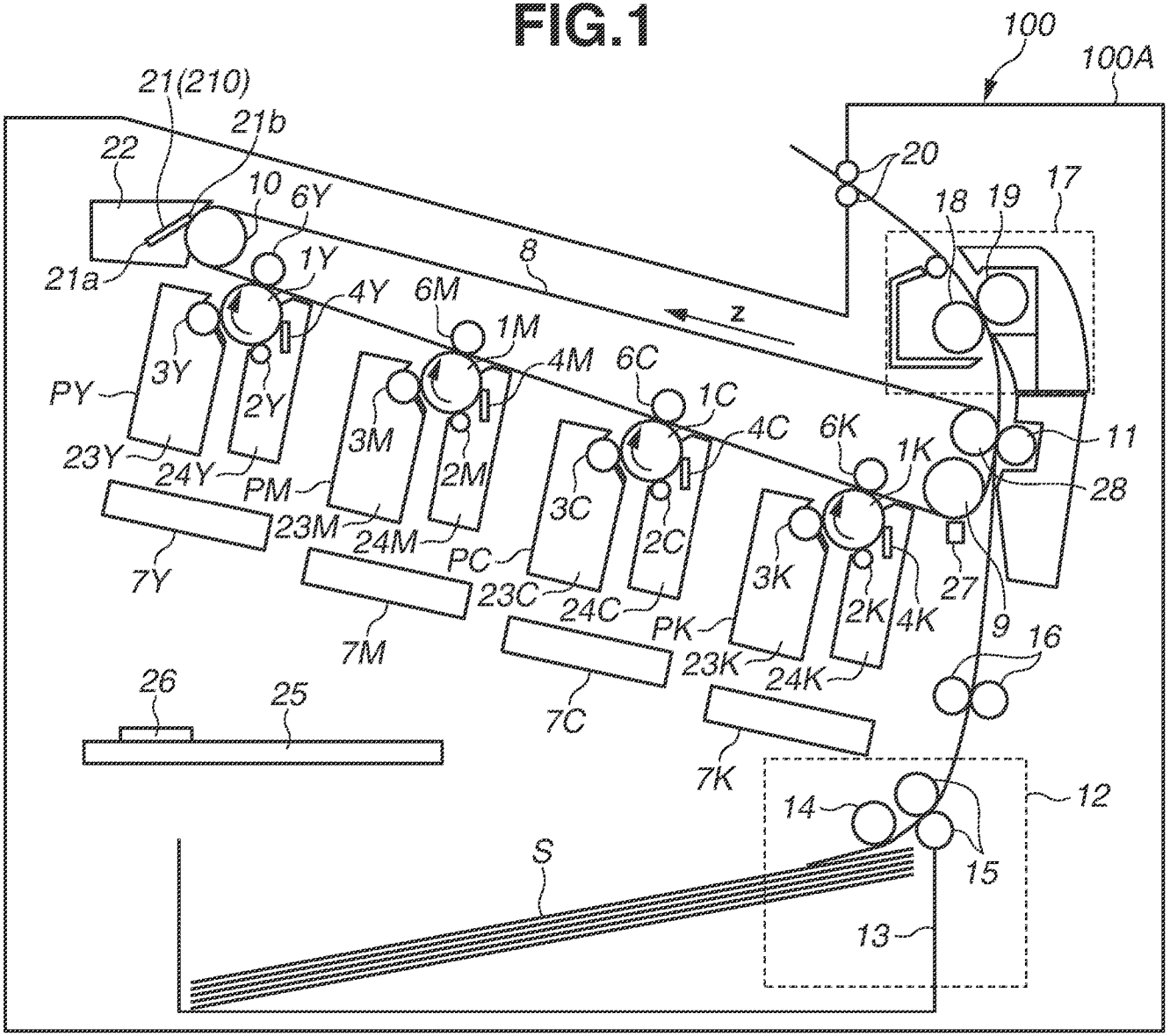
FIG. 1 is a conceptual cross-sectional view illustrating an image forming apparatus according to an exemplary embodiment of the present disclosure.

FIG. 1 is a conceptual cross-sectional view illustrating the image forming apparatus according to the present exemplary embodiment. Specifically, FIG. 1 is a longitudinal cross-sectional view schematically illustrating the image forming apparatus viewed from the front face. In the following descriptions, trailing symbols Y, M, C, and K supplied to reference numerals indicate toner colors, and the symbols will be omitted for descriptions common to the four colors.

As illustrated in FIG. 1, an electrophotographic laser beam printer is used as an example of an image forming apparatus. The electrophotographic laser beam printer can form an image with a process speed of 210 mm/s and a printing resolution of 600 dots per inch (dpi) on Legal size paper.

The image forming apparatus illustrated in FIG. 1 includes process cartridges P attachable to and detachable from the image forming apparatus. These four process cartridges P have the same structure but differ in color of toner stored therein. More specifically, the process cartridges P form images by using yellow (Y), magenta (M), cyan (C), and black (K) toners.

Each process cartridge P includes a toner container 23, a photosensitive drum 1 as an image carrier, a charging roller 2, a developing roller 3, a drum cleaning blade 4, and a waste toner container 24.

A laser unit 7 disposed below the process cartridge P subjects the photosensitive drum 1 to exposure based on an image signal. The charging roller 2 is applied with a predetermined negative voltage. After the photosensitive drum 1 has been charged to a predetermined negative potential, an electrostatic latent image is formed by the laser unit 7. When the developing roller 3 is applied with a predetermined negative voltage, the electrostatic latent image is thereby subjected to reversal development, and a toner image is formed on the photosensitive drum 1.

According to the present exemplary embodiment, the used toner is made of toner particles with an average particle diameter of 5.4 micrometers (μm), and externally added silica microparticles with an average particle diameter of 20 nm, and is negatively charged. The average particle diameter is obtained based on the particle volume that can be measured by, for example, the Coulter method.

As illustrated in FIG. 1 or 2, an intermediate transfer belt unit includes an intermediate transfer belt 8 (a transfer belt) as an intermediate transfer member, a drive roller 9, a tension roller 10 as a stretching roller, and a facing roller 28.

The intermediate transfer belt 8 is an endless belt with a length (referred to as a longitudinal length) of 250 mm in the depth direction (refer to the direction Z2 illustrated in FIG. 2A) and a circumferential length of 712 mm. The intermediate transfer belt 8 is made by adding conducting agent to a resin material to give conductivity.

The intermediate transfer belt 8 is stretched by three different axes: the drive roller 9 with a diameter of 24 mm and a longitudinal length of 240 mm, the tension roller 10 with a diameter of 24 mm and a longitudinal length of 250 mm, and the facing roller 28 with a diameter of 16 mm and a longitudinal length of 240 mm. The intermediate transfer belt 8 is also stretched with a tension (total pressure) of 100 N by the tension roller 10. The configuration of the intermediate transfer belt 8 will be described in detail below.

On the inner side of the intermediate transfer belt 8, a primary transfer roller 6 as a primary transfer member is disposed to face the photosensitive drum 1. The primary transfer roller 6 is applied a transfer voltage by a voltage application unit (not illustrated).

Optical sensors 27 as toner detection sensors are disposed at 100 mm positions to the right and left of the center of the intermediate transfer belt 8 in the longitudinal direction Z2. The optical sensors 27 are disposed to face the drive roller 9 and configured to detect a calibration patch as a toner image for correction formed on the intermediate transfer belt 8.

Each photosensitive drum 1 rotates in the direction of the arrow, the intermediate transfer belt 8 rotates in the direction of the arrow Z by an intermediate transfer belt drive unit (not illustrated), and the primary transfer roller 6 is applied with a positive voltage.

The toner image formed on the photosensitive drum 1 is primarily transferred onto the intermediate transfer belt 8. Starting from the toner image on the photosensitive drum 1Y, toner images are sequentially primarily transferred from the photosensitive drums 1 onto the intermediate transfer belt 8. The toner images of the four different colors in an overlaid state (hereinafter referred to as a 4-color toner image) are conveyed to a secondary transfer portion (secondary transfer nip) formed by a secondary transfer roller 11 as a secondary transfer member and the facing roller 28.

A conveyance apparatus 12 includes a feed roller 14 configured to feed a recording material S from a sheet cassette 13 for storing recording materials S, and a conveyance roller pair 15 configured to convey the fed recording material S. The recording materials S conveyed from the conveyance apparatus 12 is further conveyed to the secondary transfer portion by a registration roller pair 16.

The secondary transfer roller 11 is applied with a positive voltage to transfer the toner image from the intermediate transfer belt 8 onto the recording material S. This enables a secondary transfer of the toner image on the intermediate transfer belt 8 onto the recording material S being conveyed. The recording material S on which the toner image is transferred is conveyed to the fixing device 17. The recording material S is heated and pressurized by a fixing film 18 and a pressure roller 19, and the toner image is fixed to the surface of the recording material S. The recording material S on which the toner image is fixed is discharged by a discharge roller pair 20.

After the toner image has been transferred onto the recording material S, primary transfer residual toner remaining on the surfaces of the photosensitive drums 1 is removed by the drum cleaning blades 4.

After the intermediate transfer belt 8 rotates in the direction of the arrow Z, secondary transfer residual toner is scratched by a cleaning blade 21 as a cleaning member and then collected into a waste toner collection container 22. The cleaning blade 21 is formed of a galvanized steel plate with a longitudinal length of 240 mm and a thickness of 3 mm, and a urethane rubber blade 210 (sometimes simply referred to as a blade) with a longitudinal length of 230 mm, a thickness of 2 mm, and a hardness of 77 degrees conforming to Japanese Industrial Standards (JIS) K6253, stuck on the galvanized steel plate. The cleaning blade 21 is in pressure contact with the tension roller 10 in the counter direction via the intermediate transfer belt 8, with a linear pressure of 0.49 N/cm and a total pressure of about 11.3 N.

The "counter direction" refers to the direction from the downstream side toward the upstream side in the moving direction Z of (the surface of) the intermediate transfer belt 8. The cleaning blade 21 is disposed on the downstream side of the secondary transfer portion in the moving direction Z of (the surface of) the intermediate transfer belt 8. The free end 21*b* of the cleaning blade 21 is disposed so as to extend from an attachment end 21*a* where the cleaning blade 21 is attached to an apparatus main body 100A via a pressure spring (not illustrated), toward the upstream side in the moving direction Z.

The cleaning blade 21 may be an elastic member and is desirably formed of a rubber blade.

A control substrate 25 mounts one or more electrical circuits for controlling the image forming apparatus. A central processing unit (CPU) 26 as a control unit is mounted on the control substrate 25. The CPU 26 controls an intermediate transfer belt drive motor as the driving source of the intermediate transfer belt 8, which is related to the conveyance of the recording material S, the driving source (not illustrated) of the conveyance apparatus 12, the registration roller pair 16, and the fixing device 17, and a drum motor (not illustrated) as the driving source of the process cartridges P. The CPU 26 also collectively controls operations of the image forming apparatus such as controls of various image signals related to image forming, density correction controls based on the detection result by the optical sensors 27, and failure detection related controls.

(Configuration of Intermediate Transfer Belt)

The intermediate transfer belt 8 that characterizes the present exemplary embodiment will now be described with reference to FIGS. 2A, 2B, 3A, and 3B.

Figure 2B:
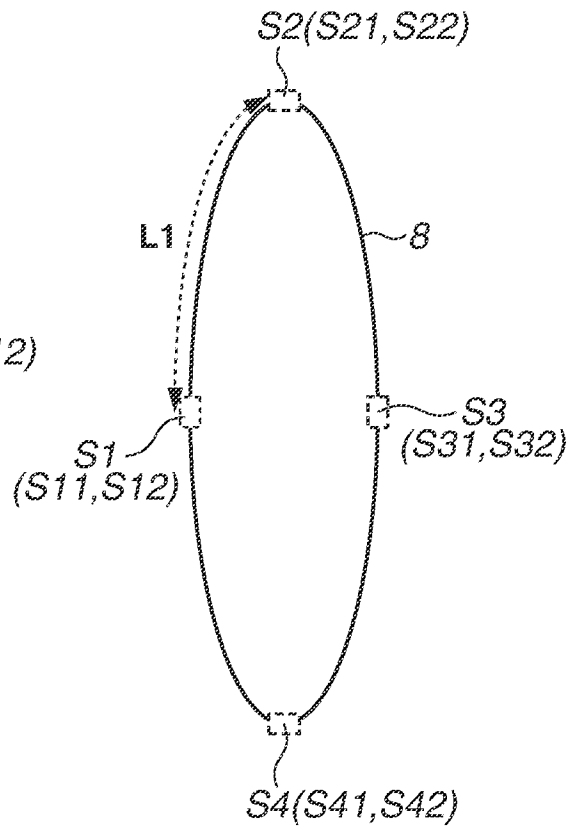
FIG. 2B is a conceptual side view illustrating the intermediate transfer belt according to the exemplary embodiment of the present disclosure.
Figure 2A:
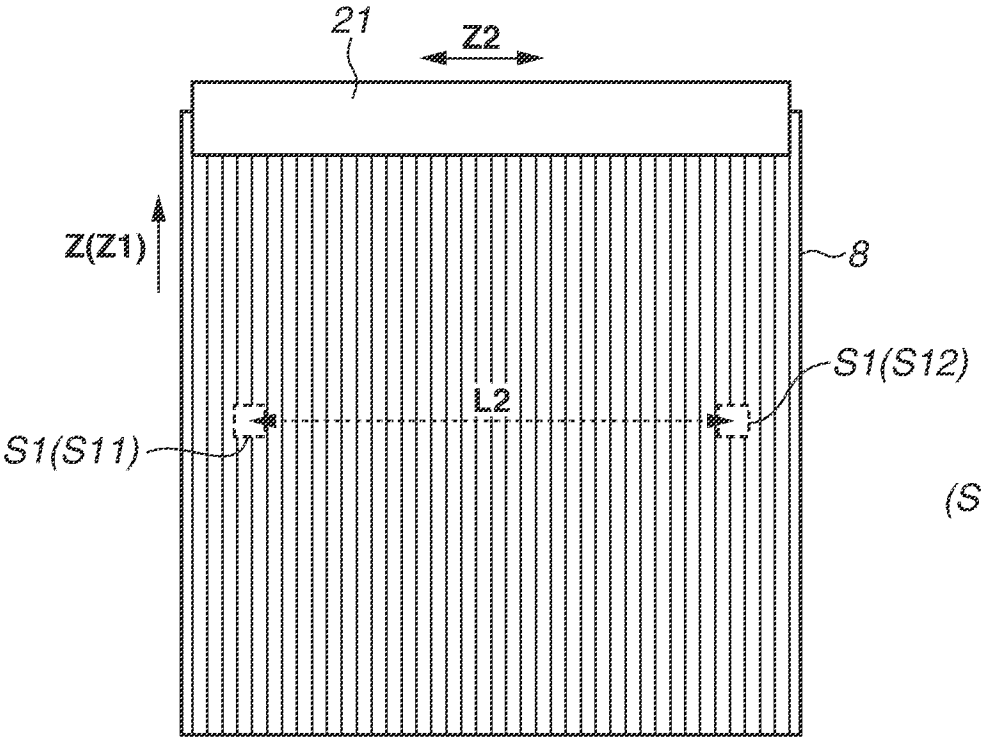
FIG. 2A is a conceptual top view illustrating an intermediate transfer belt according to an exemplary embodiment of the present disclosure.

FIG. 2A is a conceptual top view illustrating the intermediate transfer belt 8 according to the present exemplary embodiment. FIG. 2B is a conceptual side view illustrating the intermediate transfer belt 8.

Figure 3A:
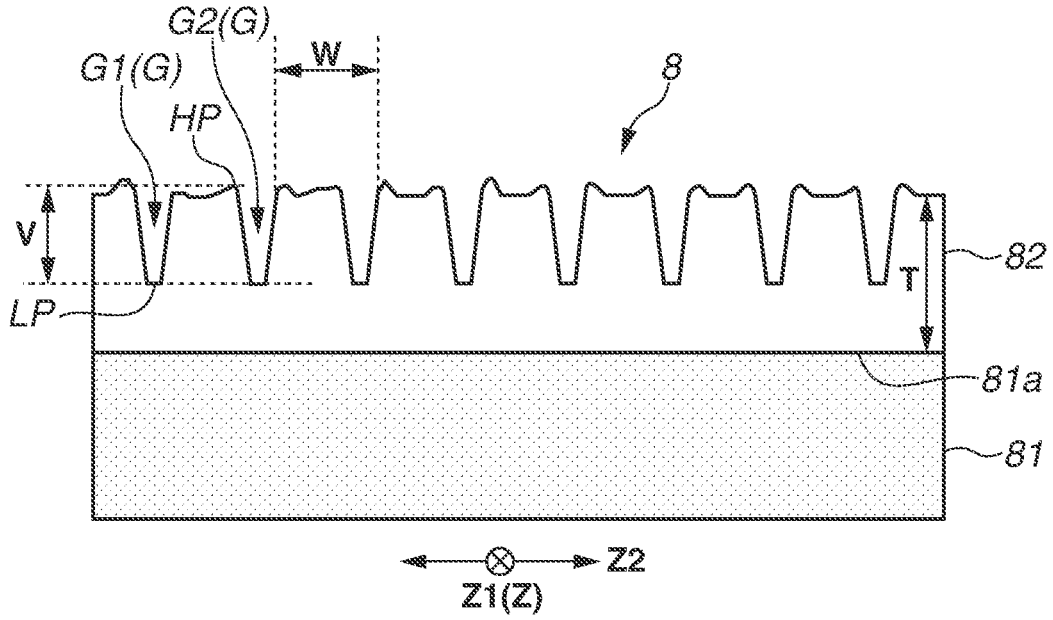
FIGS. 3A and 3B are enlarged conceptual cross-sectional views illustrating the intermediate transfer belt according to an exemplary embodiment of the present disclosure.
Figure 3B:
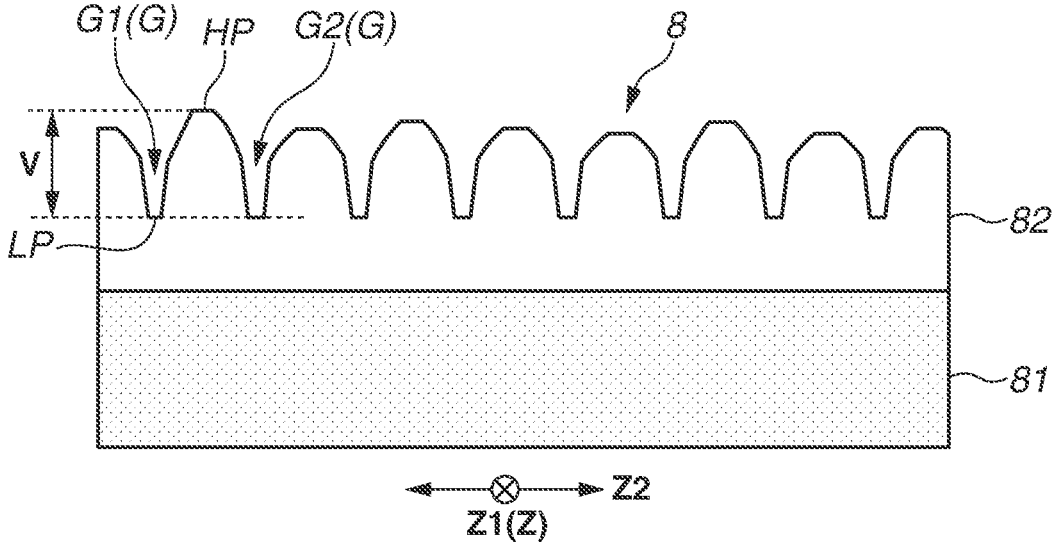

FIGS. 3A and 3B are enlarged conceptual cross-sectional views illustrating the intermediate transfer belt 8 according to the exemplary embodiment of the present disclosure.

More specifically, FIGS. 3A and 3B are partial cross-sectional views illustrating the intermediate transfer belt 8 schematically enlarged in a region of about 30 μm in the second direction Z2 substantially perpendicularly intersecting with the belt moving direction Z.

As illustrated in FIGS. 2A and 2B or FIGS. 3A and 3B, the intermediate transfer belt 8 is an endless belt member (illustrated in FIG. 2B) formed of two different layers: a base layer 81, and a surface layer 82 stacked on a front surface 81*a* of the base layer 81. The surface of the surface layer 82 is provided with a plurality of longitudinal microgrooves G in a first direction Z1 along the moving direction Z of the intermediate transfer belt 8.

More specifically, the plurality of grooves G extends along the first direction and is arranged to be aligned in the second direction Z2, according to the present exemplary embodiment. The plurality of grooves G is disposed in parallel.

According to the present exemplary embodiment, the moving direction Z of the intermediate transfer belt 8 is almost the same as the first direction (direction of groove extension). However, the first direction may not be the same as the moving direction Z but may extend along the moving direction Z. More specifically, the first direction Z1 (grooves) may be disposed to intersect with the moving direction Z at a predetermined angle (e.g., 5 degrees or less). The second direction Z2 perpendicularly intersects with the first direction Z1 (direction of groove width).

In addition to the microgroove (G) shapes with a pitch of several micrometers, the intermediate transfer belt 8 is applied with unevenness shapes waving at intervals of several tens to a hundred micrometers.

The present exemplary embodiment employs imprint processing as a method for forming microgroove shapes on the belt surface.

To apply wavy unevenness shapes at intervals of several tens to 100 micrometers to the surface layer 82, a method for adding particles or the agglutinative action of the surface layer material can be utilized.

The present exemplary embodiment forms wavy shapes by utilizing the agglutinative action of conductive metallic oxide particles in the surface layer 82 based on alkali metal ion in the base layer 81. The configuration of the intermediate transfer belt 8 according to the present exemplary embodiment will now be described.

For the base layer 81, a seamless belt-shaped layer with a thickness of 60 μm and a volume resistivity of 1*10^10 ohm-centimeters (Ω·cm) was obtained by adding an ion conducting agent as a conductive to a polyethylenenaphthalate resin (PEN) and a polyether-ester amide (PEEA) for the extrusion molding. In the present exemplary embodiment, we used TR-8550 manufactured by Teijin Chemicals Ltd. as a PEN resin, and PELESTAT NC6321 manufactured by Sanyo Chemical Industries, Ltd. as a PEEA resin.

In the present exemplary embodiment, a PEN and a PEEA resin was used as the materials of the intermediate transfer belt 8. However, other thermoplastic resin materials are also applicable. Examples of applicable resin materials include polyimide, polyester, polycarbonate, polyarylate, acrylonitrile-butadiene-styrene copolymer (ABS), polyphenylene sulfide (PPS), and polyvinylidene fluoride (PVdF). Mixtures of these resin materials are also applicable.

Alkali metal salt can be used as the ion conductive material as the conducting agent for the base layer 81. From a viewpoint of using the agglutinative action with conductive metallic oxide particles in the surface layer 82, it is more desirable to use perfluoroalkyl sulfonic acid alkali metal salt or perfluoroalkyl sulfonimide alkali metal salt. In the present exemplary embodiment, EF-N442 manufactured by Mitsubishi Materials Electronic Chemicals Co., Ltd. was used.

For the surface layer 82, the base layer 81 was subjected to dip coating of a "curable composition" with polyfunctional acrylic monomers, photopolymerization initiator, and conductive metallic oxide particles dissolved and dispersed.

Then, the dip-coated layer was subjected to ultraviolet irradiation to obtain an acrylic resin layer (surface layer 82) with a thickness T of 3 μm.

Examples of applicable methods for coating the surface layer 82 include spray coating, flow coating, shower coating, roll coating, and spin coating for forming a uniform film.

Applicable curing methods are not particularly limited but include active radiations, such as alpha rays, gamma rays, X-rays, visible light, and electron rays, that can apply energy for generating a polymerization initiation seed.

To make it easier to perform thermal deformation of the base layer 81 through the imprint processing described below, it is desirable to set the thickness T of the surface layer 82 on the front surface 81A of the base layer 81 to 3 μm or less.

In the present exemplary embodiment, we used ARONIX M-402 manufactured by Toagosei Company, Limited as polyfunctional acrylic monomers, and IRGACURE 907 manufactured by BASF SE as a photopolymerization initiator.

Conductive metallic oxide particles are added for the purpose of applying suitable conductivity to the surface layer 82 and forming suitable convex shapes through agglutination. Conductive metallic oxide particles are subjected to alkylamine processing for the purpose of the stable dispersion in a solvent and the deviation to the positive side through negative charging and alkali metal ion absorption and coordination.

Alkylamine processing can be performed by subjecting a mixture of conductive metallic oxide particles, 2-butanone, and tri-n-butylamine to distributed processing with bead mill. From a viewpoint of using the agglutinative action by using alkali metal ion in the base layer 81, the use of antimonic acid zinc particles is desirable. In the present exemplary embodiment, CELLNAX CX-Z400K manufactured by Nissan Chemical Corporation was used.

As a solvent of the curable composition, perfluoroalkyl sulfonic acid alkali metal salt or perfluoroalkyl sulfonimide alkali metal salt contained in the base layer 81 can be dissolved, and the components included in the surface layer 82 need to be stably dispersed and dissolved. From this viewpoint, the use of 2-butanone or 4-methyl-2-pentanone is desirable.

Other solvents can be added for the purpose of adjusting the evaporation rate and the viscosity of the solvent. More specifically, alcohols, ketones, esters, ethers, hydrocarbons, amides, and other solvents can be used (added). It is more desirable to use solvents, such as methyl isobutyl ketone, methyl ethyl ketone, cyclohexanone, propylene glycol monomethyl ether acetate, propylene glycol monoethyl ether acetate, toluene, and xylene.

The following describes a mechanism in which unevenness shapes (wavy shapes) are formed through the agglutinative action of conductive metallic oxide particles in manufacturing an intermediate transfer belt 8 with the above-described materials and processes.

In the curable composition as the base material of the surface layer 82, conductive metallic oxide particles have negative charges to maintain a stable dispersion state.

When the base layer 81 is subjected to dip coating of the curable composition, alkali metal salt existing in the base layer 81 is dissolved by the solvent, resulting in an increase in the density of alkali metal ion in the surface layer film. When the volatilization of the solvent progresses, the density of alkali metal ion in the surface layer film further increases.

In this case, alkali metal ion in the surface layer film is coordinated and attached to conductive metallic oxide particles, negative charges of conductive metallic oxide particles are lost, and the agglutination occurs between conductive metallic oxide particles. Using and controlling this property enable obtaining desired unevenness shapes (wavy shapes) on the surface.

In general, sliding urethane rubber (the cleaning blade 21) and an acrylic resin (the surface of the intermediate transfer belt 8) causes the chatter or burr of the cleaning blade 21 because of the large frictional resistance. According to the present exemplary embodiment, microgroove processing is therefore performed to form the grooves G in the first direction along the moving direction Z of the surface of the intermediate transfer belt 8 (the conveyance direction of the intermediate transfer belt 8). The grooves G have an average groove pitch of about 4 μm in the second direction Z2 (direction of groove width). According to the present exemplary embodiment, the groove pitch refers to the distance W between rising portions of adjacent convex shapes illustrated in FIG. 3A.

(Imprint Processing)

A method for forming the grooves G on the intermediate transfer belt 8 according to the present exemplary embodiment through the imprint processing will now be described with reference to FIGS. 4A to 4C.

Figure 4A:
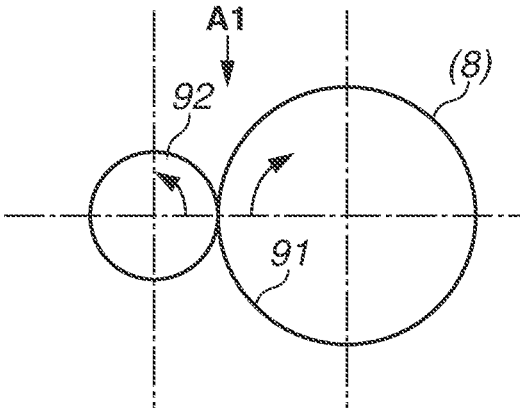
FIGS. 4A and 4B are conceptual cross-sectional views illustrating an imprint processing apparatus according to an exemplary embodiment of the present disclosure.
Figure 4B:
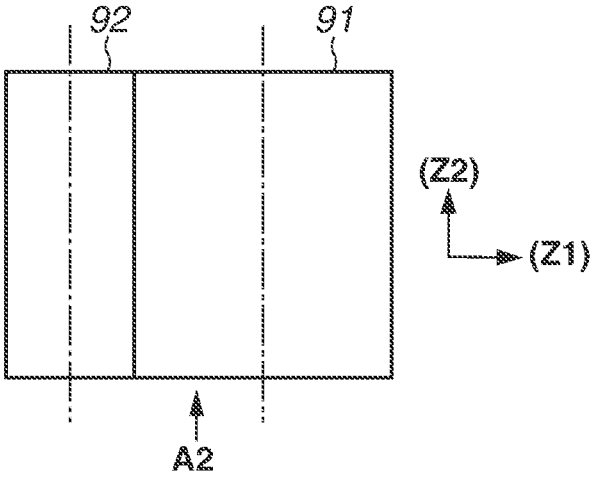

FIGS. 4A and 4B are conceptual cross-sectional views illustrating an imprint processing apparatus according to the present exemplary embodiment.

Figure 4C:
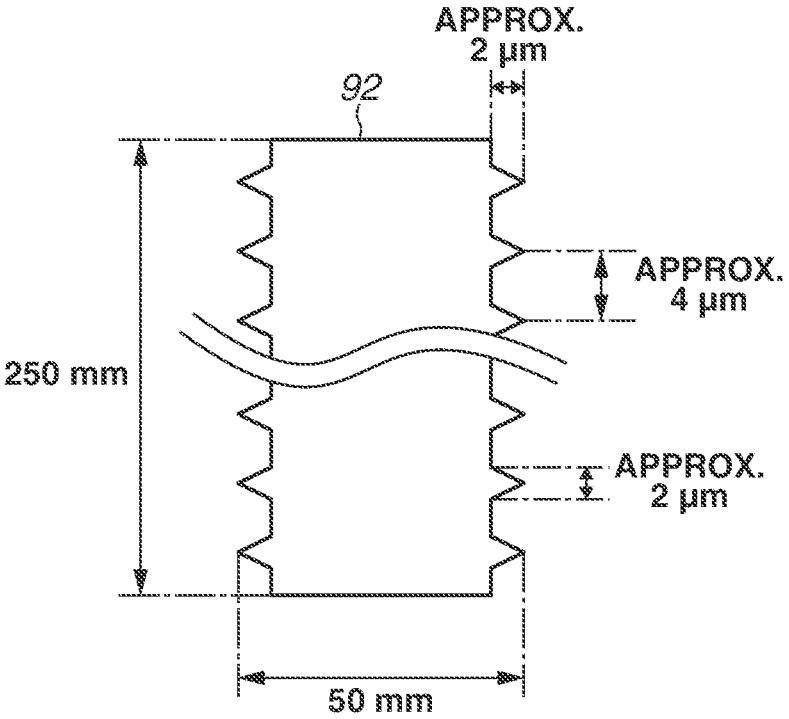
FIG. 4C is a conceptual cross-sectional view illustrating a mold to be used for imprint processing.

FIG. 4C is a conceptual cross-sectional view illustrating a mold to be used for the imprint processing.

More specifically, FIG. 4A is a schematic view illustrating the imprint processing apparatus taken along the direction A2 illustrated in FIG. 4B. FIG. 4B is a schematic view illustrating the imprint processing apparatus taken along the direction A1 illustrated in FIG. 4A. FIG. 4C is a schematic view illustrating a cross-sectional shape of the mold to be used for the imprint processing taken along the direction A1.

In the imprint processing, the intermediate transfer belt 8 with the surface layer 82 formed on the base layer 81 is firstly press-fit into a core 91 with a diameter of 227 mm made of carbon tool steel.

A cylindrical mold 92 having a diameter of 50 mm and a length of 250 mm is brought into pressure contact with the surface of the inserted intermediate transfer belt 8 (on the side of the surface layer 82) with a predetermined pressing force. The surface of the mold 92 is provided with "wedge-shaped" convex portions in the circumferential direction of the cylindrical mold 92, as illustrated in FIG. 4C, through cutting processing. The wedge-shaped convex portions are parallelly formed at equal intervals of about 4 μm (corresponding to the interval between the grooves G) in the circumferential direction of the cylindrical mold 92. The length of the bottom of a wedge-shaped convex portion (corresponding to the groove width in the Z2 direction) is about 2.0 μm. The height of a wedge-shaped convex portion (corresponding to the depth of the groove G) is about 2.0 μm.

The mold 92 is heated by a heater (not illustrated) to a temperature of 130° C. which is 5 to 15° C. higher than the glass transfer temperature of polyethylenenaphthalate. The intermediate transfer belt 8 having been subjected to the microgroove processing was obtained by rotating once the core 91 in contact with the mold 92 across the intermediate transfer belt 8 at a circumferential speed of 264 mm/s to allow the mold 92 to be driven, and then separating the mold 92.

(Evaluation Method)

[Arithmetic Average Roughness (Three-Dimensional Roughness) Sa of Region Surface]

The unevenness shapes (wavy shapes) obtained through the agglutinative action were measured by using a scanning white-light interference microscope VS1550 manufactured by Hitachi High-Tech Science Corporation.

As illustrated in FIG. 2B, the measurement was performed at two predetermined positions for each of the four predetermined phases S1, S2, S3, and S4, i.e., at a total of eight positions (S11, S12, S21, S22, S31, S32, S41, and S42), in the circumferential direction of the intermediate transfer belt 8. The average value of the measurement results for the eight positions was then set as an arithmetic average roughness Sa of the surface of the target intermediate transfer belt 8 in the predetermined region S.

According to the present exemplary embodiment, the four phases S1 to S4 were uniformly set in the circumferential direction of the intermediate transfer belt 8. The measurement positions S11 and S12 are set to symmetry positions with respect to the center position in the width direction Z2.

More specifically, for example, a length L1 of the intermediate transfer belt 8 between the phases S1 and S2 is set to 178 mm, and a distance L2 between the phases S11 and S12 is set to 180 mm, according to the present exemplary embodiment as illustrated in FIG. 2B.

As a detailed setting for the scanning white-light interference microscope VS1550, the measurement was performed for the predetermined region S with a size of approximately 1,100 by 1,100 μm in the Wave mode by using a ×10 object lens. The obtained two-dimensional height information was subjected to surface profile correction based on a four-dimensional polynomial and then analysis under a no-cutoff condition to calculate an arithmetic average roughness (three-dimensional roughness) Sa for each field (predetermined region S).

(Groove Depth V)

The groove depth V of the grooves G formed on the surface layer 82 of the intermediate transfer belt 8 was measured by using a laser microscope VK-X250 manufactured by KEYENCE CORPORATION.

As illustrated in FIG. 2B, the measurement was performed at two predetermined positions for each of the four predetermined phases S1, S2, S3, and S4, i.e., at a total of eight positions (S11, S12, S21, S22, S31, S32, S41, and S42), in the circumferential direction of the intermediate transfer belt 8.

As a detailed setting for the laser microscope VK-X250, the measurement was performed in a state where 24 grooves fit into the field by using a ×150 object lens for a predetermined region with a size of approximately 70 by 90 μm.

A measurement line is drawn on the obtained two-dimensional height information perpendicularly to the groove direction (first direction Z1) in a line profile measurement mode. Thereafter, the distance from the peak (mountain HP)

at the highest point to the bottom (valley LP) at the lowest point is obtained as a "groove depth V". The peak and the bottom are lying between adjacent longitudinal grooves G1 and G2.

In a case where raised shapes are formed at both ends of a groove edge, as illustrated in FIG. 3A, the higher shape of the two ends is set as the peak (mountain HP) between the longitudinal grooves G1 and G2, and the groove depth V is obtained.

In a case where no raised portions are formed at both ends of a groove edge, as illustrated in FIG. 3B, the higher flat portion of the both ends is set as the peak (mountain HP), and the distance from the bottom of the groove (valley LP) to the peak is obtained as the groove depth V.

The measurement of the groove depth V was performed for all (24) grooves in the field (predetermined region) with a size of about 70 by 90 μm. The average value of the first to the sixth largest groove depths V (top 25%) is calculated as the "maximum groove depth Vmax", and the average value of the first to the sixth smallest groove depths V (bottom 25%) is calculated as the "minimum groove depth Vmin" of all grooves in the field (predetermined region).

The average values are obtained for the maximum groove depths Vmax and the minimum groove depths Vmin of the eight measurement fields (predetermined regions). The average values were determined to be the maximum groove depth Vmax and the minimum groove depth Vmin of the target intermediate transfer belt 8. In addition, the average value of all of the groove depths of the eight measurement fields was calculated as the average groove depth.

(Friction Coefficient of Intermediate Transfer Belt with Cleaning Blade)

Using the A4-size paper GF-0081 manufactured by Canon Inc., a text image with a 5% printing ratio was printed on 500 pages under the environmental of the 30° C. temperature and the 80% humidity. Thereafter, the torque of the intermediate transfer belt unit was measured by using a torque gauge attached to the drive roller 9.

Furthermore, we measured the torque in a similar way in a state where the cleaning blade 21 was removed from the intermediate transfer belt unit, and then obtained the difference between the measured torque and the torque value with the cleaning blade 21 attached. The pure torque between the intermediate transfer belt 8 and the cleaning blade 21 was thereby calculated. We calculated the friction coefficient by calculating the quotient with 27.12 Ncm (the drive roller radius 1.2 cm times the total pressure 11.3N of the cleaning blade 21) for the obtained torque (Ncm).

(Cleaning Blade Chatter)

After the measurement of the friction coefficient with the cleaning blade 21, we kept rotating the intermediate transfer belt unit for 5 minutes under the environment of 30° C. temperature and 80% humidity, and determined the presence of an abnormal sound due to the blade chatter.

EXEMPLARY EMBODIMENTS (EXPERIMENTS)

The present exemplary embodiment will be described in detail below with reference to exemplary embodiments (experiments) and comparative examples (experiments). The scope of the present exemplary embodiment is not limited to the following exemplary embodiments (experiments).

Table 1 illustrates compounding ratios of materials of the base layer 81 and the surface layer 82, an imprint processing pressure, and an evaluation result.

The compounding ratios of the base layer 81 are represented by the mass ratios on the premise that the sum of the masses of PEN and PEEA as base resins is 100. The compounding ratios of the surface layer 82 are represented by the mass ratios on the premise that the sum of the masses of acrylic monomers and photopolymerization initiator as base resins is 100.

Figure 5A:
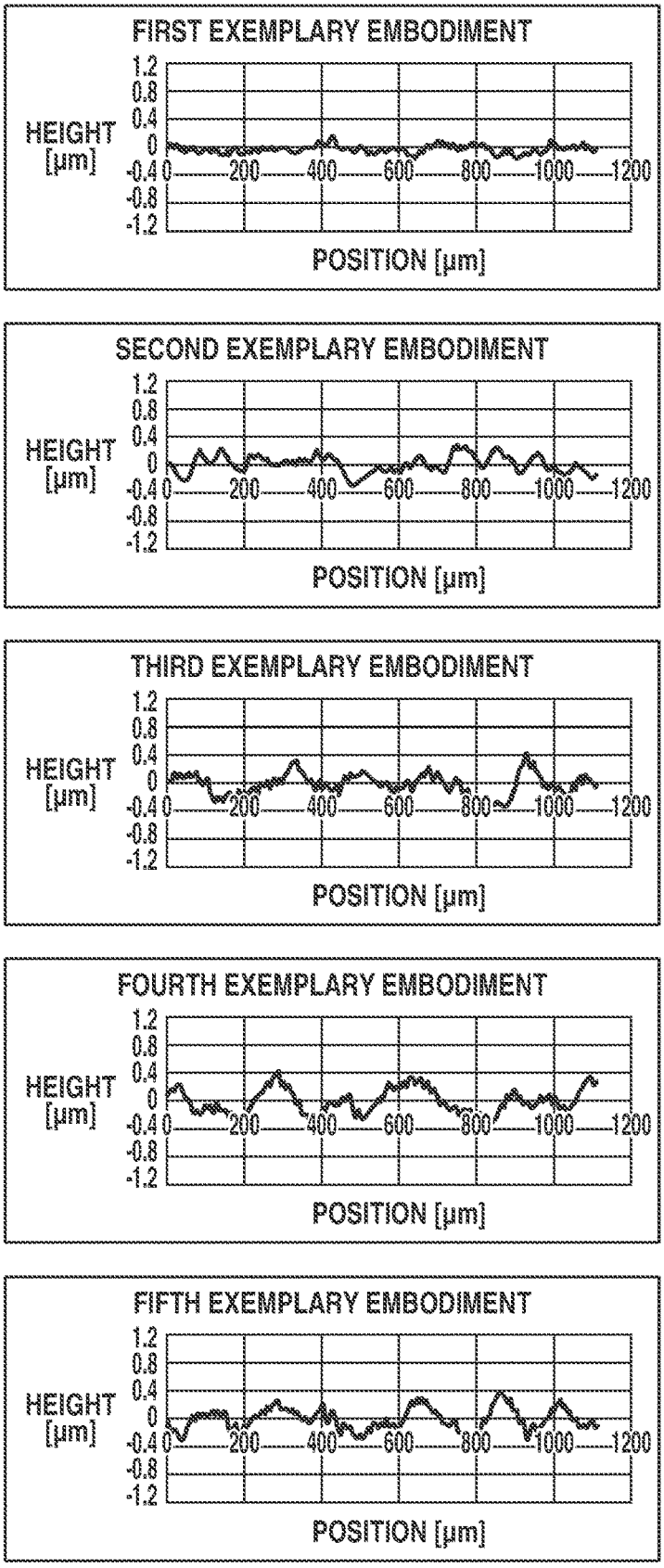
FIGS. 5A and 5B are graphs illustrating surface profiles of a surface layer of an intermediate transfer belt according to exemplary embodiments and comparative examples of the present disclosure.
Figure 5B:
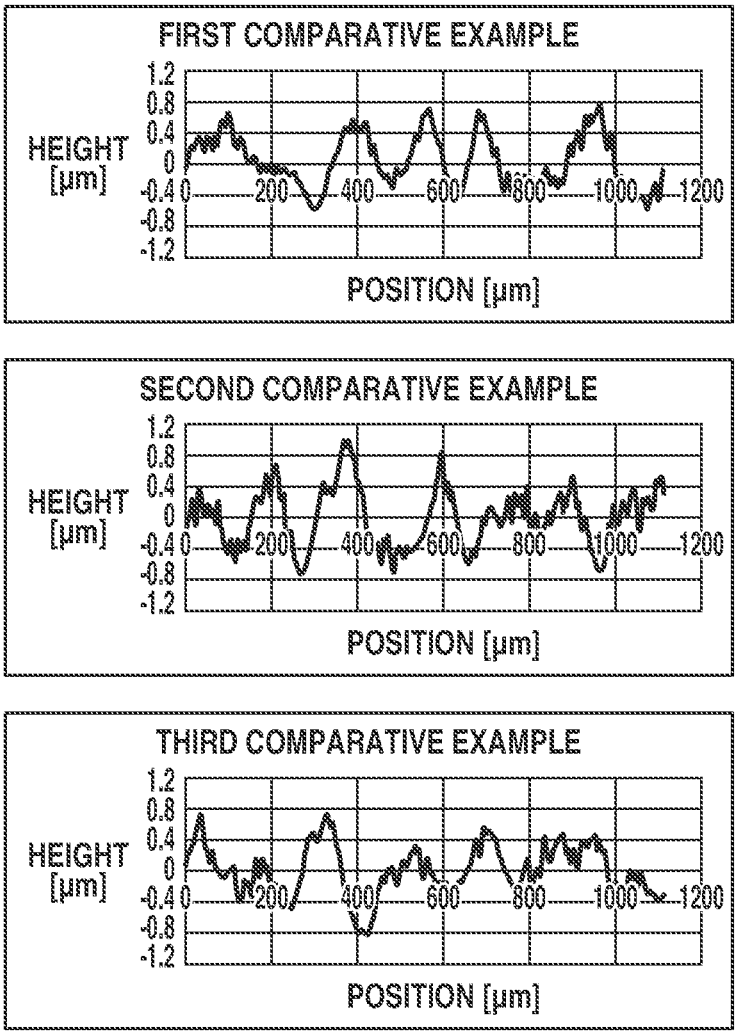

FIGS. 5A and 5B are graphs illustrating surface profiles of the surface layer 82 of the intermediate transfer belt 8 according to each of the exemplary embodiments and comparative examples of the present exemplary embodiment.

More specifically, FIGS. 5A and 5B illustrates results of measuring surface profiles of the intermediate transfer belt 8 according to the first to the fifth exemplary embodiments and the first to the third comparative examples by using a scanning white-light interference microscope VS1550, and measuring the height in a line profile measurement mode.

TABLE 1

Material compounding ratios, imprint pressure, and evaluation result

| | | First exemplary embodiment | Second exemplary embodiment | Third exemplary embodiment | Fourth exemplary embodiment |
|---|---|---|---|---|---|
| Base layer | PEN | 88 | 88 | 88 | 82 |
| | PEEA | 12 | 12 | 12 | 18 |
| | Alkali metal salt | 2.3 | 2.3 | 2.3 | 1 |
| Surface layer | Acrylic monomers | 95 | 95 | 95 | 95 |
| | Photopolymerization initiator | 5 | 5 | 5 | 5 |
| | Conductive oxide particles | 5 | 15 | 25 | 35 |
| | 2-butanone | 200 | 200 | 200 | 200 |
| | 4-methyl-2-pentanone | 140 | 140 | 140 | 140 |
| Imprint pressure (N) | | 2500 | 2500 | 2500 | 2500 |
| Sa (μm) | | 0.05 | 0.09 | 0.17 | 0.2 |
| Average groove depth (μm) | | 0.47 | 0.46 | 0.46 | 0.44 |
| Maximum groove depth (μm) | | 0.5 | 0.5 | 0.54 | 0.55 |
| Minimum groove depth (μm) | | 0.43 | 0.41 | 0.37 | 0.32 |
| Friction coefficient | | 0.55 | 0.57 | 0.61 | 0.65 |
| Cleaning blade chatter | | ○ | ○ | ○ | ○ |
| | | Fifth exemplary embodiment | First comparative example | Second comparative example | Third comparative example |

TABLE 1-continued

| Material compounding ratios, imprint pressure, and evaluation result | | | | | |
|---|---|---|---|---|---|
| Base layer | PEN | 88 | 88 | 88 | 82 |
| | PEEA | 12 | 12 | 12 | 18 |
| | Alkali metal salt | 2.3 | 2.3 | 2.3 | 1 |
| Surface layer | Acrylic monomers | 95 | 95 | 95 | 95 |
| | Photopolymerization initiator | 5 | 5 | 5 | 5 |
| | Conductive oxide particles | 25 | 35 | 45 | 45 |
| | 2-butanone | 200 | 200 | 200 | 200 |
| | 4-methyl-2-pentanone | 140 | 140 | 140 | 140 |
| Imprint pressure (N) | | 1500 | 2500 | 2500 | 2500 |
| Sa (μm) | | 0.17 | 0.26 | 0.3 | 0.27 |
| Average groove depth (μm) | | 0.32 | 0.34 | 0.33 | 0.34 |
| Maximum groove depth (μm) | | 0.43 | 0.57 | 0.59 | 0.57 |
| Minimum groove depth (μm) | | 0.2 | 0.11 | 0.07 | 0.1 |
| Friction coefficient | | 0.7 | 0.75 | 0.8 | 0.76 |
| Cleaning blade chatter | | ○ | x | x | x |

First to Third Exemplary Embodiments

As a result of maintaining the quantity of "alkali metal salt" of the base layer 81 and "imprint pressure", and increasing the content rate of "conductive metallic oxide particles" in the surface layer 82 to 5 parts by mass (first exemplary embodiment), 15 parts by mass (second exemplary embodiment), and 25 parts by mass (third exemplary embodiment), the arithmetic average roughness Sa of the surface increased, and the friction coefficient also exhibited a tendency to increase.

According to the first to the third exemplary embodiments, the maximum groove depth also increased but the minimum groove depth exhibited a tendency to decrease, as a result of the increase in the arithmetic average roughness Sa. The wavy unevenness (undulation) of the surface layer 82 increases depending on the content volume of "conductive metallic oxide particles". It is conceivable that, the "concave" portions of the wavy unevenness become unlikely to be subjected to the imprint processing (mold transfer), and the "convex" portions become likely to be subjected to the concentration of the load (pressure) of the imprint (mold).

As the first to the third exemplary embodiments are illustrated in FIG. 5A, the maximum undulation of wavy unevenness shapes in the region (range) of approximately 1,100 μm was about 0.3 μm according to the first exemplary embodiment, and increased to about 0.9 μm according to the third exemplary embodiment. A possible cause of this measurement result is that the wedges (2 μm high) of the mold 92 are more unlikely to break into the concave portions on the surface (surface layer 82) of the intermediate transfer belt 8 according to the first, second, and third exemplary embodiments in this order.

As understood from the evaluation results of the first to third exemplary embodiments, the chatter of the cleaning blade 21 is unlikely to occur when the arithmetic average roughness Sa of the surface is 0.17 μm (the minimum groove depth is 0.37 μm in this case).

First and Second Comparative Examples

According to the first and the second comparative examples, the quantity of "alkali metal salt" and the imprint pressure of the base layer 81 are the same as those according to the first to the third exemplary embodiments.

The content rate of "conductive metallic oxide particles" of the surface layer 82 was increased to 35 and 45 parts by mass, respectively.

As a result of further increasing the quantity of "conductive metallic oxide particles", the arithmetic average roughness Sa of the surface increased more, and the friction coefficient exhibited a tendency to increase.

According to the first and the second comparative examples, the maximum groove depth also increased but the minimum groove depth exhibited a tendency to decrease, as a result of the increase in the arithmetic average roughness Sa. A possible cause of this measurement result is that, similarly to the first to the third exemplary embodiments, the wavy unevenness of the surface layer 82 increased, and the imprint load (pressure) concentrated on the "convex" portion because of the content volume of "conductive metallic oxide particles".

As illustrated in FIG. 5, the increase in the maximal undulation of wavy unevenness shapes in the region (range) of approximately 1,100 μm was approximately 1.3 μm according to the first comparative example, and approximately 1.7 μm according to the second comparative example. A possible cause of this measurement result is that the wedges of the mold 92 are unlikely to break into the concave portions on the surface of the intermediate transfer belt 8 (surface layer 82).

As understood from the evaluation results of the first and the second comparative examples, the chatter of the cleaning blade 21 was perceived when the arithmetic average roughness Sa of the surface was 0.26 μm or more (the minimum groove depth was 0.11 μm or less in this case).

Fourth Exemplary Embodiment

According to a fourth exemplary embodiment, we decreased the quantity of "alkali metal salt" of the base layer 81 to 1 part by mass with respect to the first comparative example, and then equalized the imprint pressure and the content rate of "conductive metallic oxide particles" of the surface layer 82 to those according to the first comparative example.

As a result, according to the fourth exemplary embodiment, the arithmetic average roughness Sa of the surface decreased, and the friction coefficient exhibited to decrease with respect to the first comparative example.

According to the fourth exemplary embodiment, as a result of the decrease in Sa, the maximum groove depth also decreased, and the minimum groove depth exhibited a tendency to increase.

As understood from the evaluation results for the fourth exemplary embodiment, the chatter of the cleaning blade 21 is unlikely to occur when the arithmetic average roughness Sa of the surface is 0.2 μm (the minimum groove depth is 0.32 μm in this case).

Third Comparative Example

According to the third comparative example, we equalized the quantity of "alkali metal salt" of the base layer 81 and the imprint pressure to those according to the fourth exemplary embodiment, and equalized the content rate of "conductive metallic oxide particles" of the surface layer 82 to that according to the second comparative example, i.e., 45 parts by mass.

As a result, Sa according to the third comparative example is larger than that according to the fourth exemplary embodiment and smaller than that according to the second comparative example.

The friction coefficient according to the third exemplary embodiment became a value between those according to the fourth exemplary embodiment and the second comparative example.

Likewise, the maximum and minimum groove depths according to the third comparative example became values between those according to the fourth exemplary embodiment and the second comparative example.

As understood from the evaluation results of the third comparative example, the chatter of the cleaning blade 21 was perceived when the arithmetic average roughness Sa of the surface was 0.27 μm (the minimum groove depth was 0.1 μm in this case).

Fifth Exemplary Embodiment

According to a fifth exemplary embodiment, only the imprint pressure was decreased from 2,500 N to 1,500 N with respect to the third exemplary embodiment.

As a result, according to the fifth exemplary embodiment, the average groove depth, the maximum groove depth, and the minimum groove depth decreased together with respect to the third exemplary embodiment.

As understood from the evaluation results of the fifth exemplary embodiment, the chatter of the cleaning blade 21 is unlikely to occur when the arithmetic average roughness Sa of the surface is 0.17 μm (the minimum groove depth is 0.2 μm in this case).

With the intermediate transfer belt 8 according to the present exemplary embodiment, as described above, regulating the arithmetic average roughness Sa of the surface of the surface layer 82 to 0.2 μm or less enables forming wavy shapes on the surface layer 82 and form grooves with a sufficient depth at the wavy concave portion on the surface layer 82. In other words, it was also confirmed that the chatter of the cleaning blade 21 was unlikely to occur.

In contrast, when Sa on the surface of the intermediate transfer belt 8 exceeds 0.2 μm, grooves with a sufficient depth are unlikely to be formed at the wavy concave portions on the surface. As a result, the friction coefficient of the surface of the intermediate transfer belt 8 is likely to exceed 0.7, and accordingly the chatter of the cleaning blade 21 is also likely to occur.

If the minimum groove depth is 0.2 μm or more, the chatter of the cleaning blade 21 is unlikely to occur (the chatter of the cleaning blade 21 can be more reliably reduced). In contrast, if the minimum groove depth is 0.11 μm or less, the chatter of the cleaning blade 21 becomes a little more likely to occur.

More specifically, the minimum groove depth can be larger than 0.11 μm, and desirably be 0.2 μm or more.

According to the present exemplary embodiment, the imprint pressure desirably be in a range from 1,000 to 3,000 N, and more desirably be 1,500 to 2,500 N.

Thus, in the imprint processing according to the present exemplary embodiment, microgrooves can reliably be formed by controlling (regulating) the wavy shapes on the surface of the intermediate transfer belt 8. In particularly, the present exemplary embodiment makes it easier to form microgrooves with which the average value of groove depths that occupy the bottom 25% (minimum groove depth Vmin) in the groove depth distribution is 0.2 μm or more. This enables reliably reducing the friction between the intermediate transfer belt 8 and the cleaning blade 21, restricting the chatter of the cleaning blade 21.

(Modification)

A modification of the present exemplary embodiment will now be described with reference to FIG. 6. Only differences between each of the above-described exemplary embodiments and the modification will be described.

Figure 6:
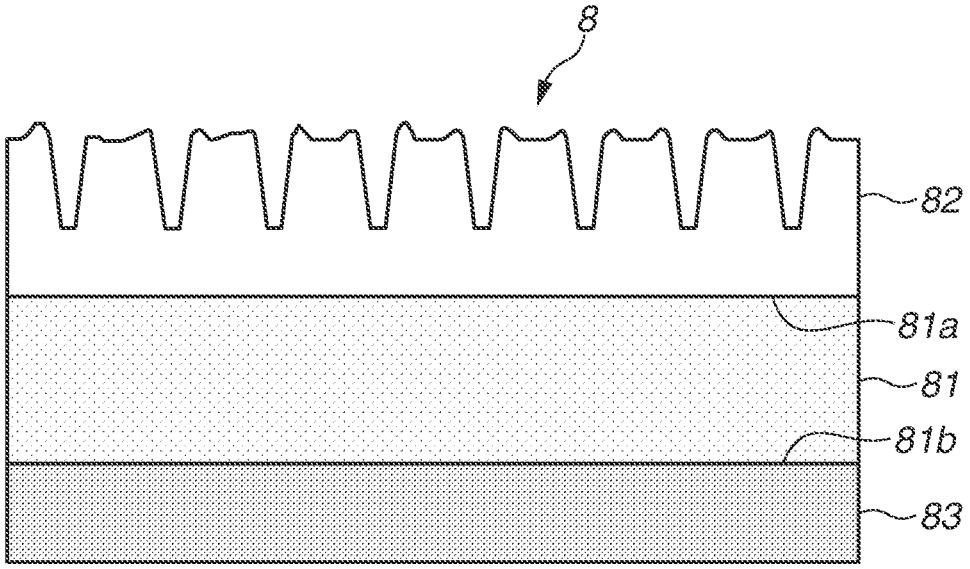
FIG. 6 is an enlarged conceptual cross-sectional view illustrating an intermediate transfer belt according to a modification of the exemplary embodiments of the present disclosure.

FIG. 6 is an enlarged conceptual cross-sectional view illustrating an intermediate transfer belt according to the modification of the exemplary embodiments of the present disclosure.

As illustrated in FIG. 6, the present modification is further provided with a third layer 83 (auxiliary layer) on the opposite side of the surface layer 82 (second layer) across the base layer 81 (first layer) of the intermediate transfer belt 8.

For example, the third layer 83 is formed by coating a back surface 81*b* with an acrylic resin with dispersed carbon black as a conducting agent, with a thickness of about 2 μm. The back surface 81*b* is in a "front and back relation" with the front surface 81*a* of the base layer 81.

According to the present exemplary embodiment, the intermediate transfer belt 8 may be formed of a plurality of layers in this way, and may be configured by three or more layers.

(Miscellaneous)

As described above, in a case of applying groove shapes to the intermediate transfer belt 8 through the imprint processing, controlling unevenness shapes (wavy shapes) on the surface of the intermediate transfer belt 8 in advance reduces the influence on the groove formation by the wavy shapes, making it possible to form desired grooves.

If desired grooves (groove depth) are not formed, the friction (coefficient) between the cleaning blade 21 and the surface of the intermediate transfer belt 8 cannot be sufficiently reduced, and the blade chatter (stick-slip) phenomenon may be actualized. The present disclosure makes it possible to form microgrooves on the intermediate transfer belt 8 through the imprint processing, effectively reducing the friction.

The configuration of the present disclosure also enables reducing the friction between the photosensitive drum and the intermediate transfer belt 8 and between the cleaning blade 21 and the intermediate transfer belt 8, restricting the "blade chatter". More specifically, the present disclosure enables implementing an intermediate transfer member having predetermined unevenness wavy shapes and microgroove shapes through the imprint processing.

The configuration of the present disclosure also enables reducing the friction and maintaining the high cleaning performance. For example, even in a configuration in which the contact pressure is increased (or a configuration in which the "contact angle" setting is increased) to cope with the escape of toner, the effect of the reduced friction can be exhibited. Thus, the present disclosure enables maintaining the high cleaning performance and reducing the friction.

In particular, even in a high-temperature high-humidity environment where the "contact angle" setting or the "contact pressure" is increased, the configuration of the present disclosure restricts the increase in the friction coefficient with the intermediate transfer belt 8 and effectively prevents the occurrence of noise due to the blade chatter.

The present disclosure can be summarized as follows.

(1) A transfer belt 8 of the present disclosure, is used in a state of being in contact with a cleaning member 21 and an image carrier 1, and a developer image is transferred from the image carrier 1 to the transfer belt 8.

The transfer belt 8 includes a surface layer 82 in contact with the image carrier 1 and the cleaning member 21, and a base layer 81 disposed at a position more apart from the image carrier 1 and the cleaning member 21 than the surface layer 82.

The surface layer 82 is provided with grooves G formed by transferring a predetermined mold shape. The grooves G extend in a first direction Z1 along a moving direction Z of the transfer belt 8 in an operating state.

An arithmetic average roughness Sa of the surface layer 82 in a predetermined region S is 0.2 μm or less.

(2) With the transfer belt 8 of the present disclosure, a plurality of the grooves (G1 and G2) may be formed on the surface layer 82 aligned along a second direction Z2 perpendicularly intersecting with the first direction Z1. A position having the maximum height between two adjacent grooves G1 and G2 in the second direction z2 is referred to as a mountain HP, and a position having the minimum height therebetween is referred to as a valley LP. If the distance from the mountain HP to the valley LP is referred to as a groove depth V, it is desirable that the average value of groove depths that occupy the bottom 25% in the groove depth distribution is 0.2 μm or more.

(3) With the transfer belt 8 of the present disclosure, the average interval W between the two adjacent grooves G1 and G2 in the second direction Z2 can be 10 μm or less.

(4) With the transfer belt 8 of the present disclosure, the thickness T of the surface layer 82 is 1 μm or more and 3 μm or less.

(5) With the transfer belt 8 of the present disclosure, the surface layer 82 may contain conductive metallic oxide particles.

(6) With the transfer belt 8 of the present disclosure, conductive metallic oxide particles are desirably antimonic acid zinc particles.

(7) With the transfer belt 8 of the present disclosure, the surface layer 82 can be stacked on the front surface 81*a* of the base layer 81 while in contact with the base layer 81, and the base layer 81 may contain alkali metal salt.

(8) With the transfer belt 8 of the present disclosure, it is desirable that the alkali metal salt is perfluoroalkyl sulfonic acid alkali metal salt or perfluoroalkyl sulfonimide alkali metal salt.

(9) With the transfer belt 8 of the present disclosure, it is desirable that the friction coefficient between the cleaning member 21 and the surface layer 82 is 0.7 or less.

(10) With the transfer belt 8 of the present disclosure, it is desirable that the arithmetic average roughness Sa of the surface layer 82 is 0.05 μm or more.

(11) With the transfer belt 8 of the present disclosure, an auxiliary layer 83 may be disposed on the side opposite to the side where the surface layer 82 is disposed across the base layer 81.

(12) An image forming apparatus 100 of the present disclosure includes the above-described transfer belt 8, the image carrier 1, and the cleaning member 21.

(13) In the image forming apparatus 100 of the present disclosure, the cleaning member 21 may have a blade 210 made of an elastic member. The blade 210 may have an attachment end 21*a* attached to an apparatus main body 100A, and a free end 21*b* that comes into contact with the surface layer 82 of the transfer belt 8. The free end 21*b* may be configured to extend from the attachment end 21*a* toward the upstream side in the moving direction Z of the transfer belt 8.

The present disclosure enables reliably reducing the friction between the cleaning member and the image carrier.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-213832, filed Dec. 23, 2020, which is hereby incorporated by reference herein in its entirety.

What is claimed is:

1. A transfer belt, to be used in a state of being in contact with a cleaning member and an image carrier, and to which a developer image is to be transferred from the image carrier, the transfer belt comprising:

a surface layer in contact with the image carrier and the cleaning member; and a base layer disposed at a position more apart from the image carrier and the cleaning member than from the surface layer, wherein the surface layer is provided with grooves formed by transferring a predetermined mold shape and extending in a first direction along a moving direction of the transfer belt in an operating state, and wherein an arithmetic average roughness Sa, as three-dimensional average roughness, of the surface layer in a predetermined region is less than or equal to 0.2 micrometers (μm), wherein the grooves include a plurality of grooves and, in the operating state, the surface layer is provided with the plurality of grooves as aligned along a second direction perpendicularly intersecting with the first direction, wherein a position having a maximum height between two adjacent grooves in the second direction is a mountain, a position having a minimum height between the two adjacent grooves is a valley, and a distance from the mountain to the valley is a groove depth, and wherein an average value of groove depths that occupy a bottom 25 percent (%) in a groove depth distribution is greater than or equal to 0.2 μm.

2. The transfer belt according to claim 1, wherein an average interval between the two adjacent grooves in the second direction is less than or equal to 10 μm.

3. The transfer belt according to claim 1, wherein a thickness of the surface layer is greater than or equal to 1 μm and less than or equal to 3 μm.

4. The transfer belt according to claim 3, wherein the surface layer contains conductive metallic oxide particles.

5. The transfer belt according to claim 4, wherein the conductive metallic oxide particles include antimonic acid zinc particles.

6. The transfer belt according to claim 1, wherein a friction coefficient between the cleaning member and the surface layer is less than or equal to 0.7.

7. The transfer belt according to claim 1, wherein the arithmetic average roughness Sa of the surface layer is greater than or equal to 0.05 μm.

8. The transfer belt according to claim 1, wherein an auxiliary layer is further disposed on a side opposite to a side where the surface layer is disposed across the base layer.

9. An image forming apparatus comprising:

the transfer belt according to claim 1;

the image carrier; and the cleaning member.

10. The image forming apparatus according to claim 9, wherein the cleaning member is provided with a blade made of an elastic material, wherein the blade has an attachment end attached to an apparatus main body, and a free end configured to come into contact with the surface layer of the transfer belt, and wherein the free end extends from the attachment end toward an upstream side in the moving direction of the transfer belt.

11. A transfer belt, to be used in a state of being in contact with a cleaning member and an image carrier, and to which a developer image is to be transferred from the image carrier, the transfer belt comprising:

a surface layer in contact with the image carrier and the cleaning member; and a base layer disposed at a position more apart from the image carrier and the cleaning member than from the surface layer, wherein the surface layer is provided with grooves formed by transferring a predetermined mold shape and extending in a first direction along a moving direction of the transfer belt in an operating state, wherein an arithmetic average roughness Sa, as three-dimensional average roughness, of the surface layer in a predetermined region is less than or equal to 0.2 micrometers (μm), wherein a thickness of the surface layer is greater than or equal to 1 μm and less than or equal to 3 μm, wherein the surface layer contains conductive metallic oxide particles, wherein the surface layer is stacked on a surface of the base layer while in contact with the surface layer, and wherein the base layer contains alkali metal salt.

12. The transfer belt according to claim 11, wherein the alkali metal salt is perfluoroalkyl sulfonic acid alkali metal salt or perfluoroalkyl sulfonimide alkali metal salt.

* * * * *